US010173108B2

(12) United States Patent
Westrum et al.

(10) Patent No.: US 10,173,108 B2
(45) **Date of Patent: *Jan. 8, 2019**

(54) GOLF CLUB HEAD COMPRISING MICROSCOPIC BUBBLE MATERIAL

(71) Applicant: Callaway Golf Company, Carlsbad, CA (US)

(72) Inventors: Joshua D. Westrum, San Diego, CA (US); Hong G. Jeon, Carlsbad, CA (US); Scott Manwaring, Carlsbad, CA (US); Brooks Roche, Ramona, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/927,917

(22) Filed: Mar. 21, 2018

(65) Prior Publication Data

US 2018/0221726 A1 Aug. 9, 2018

Related U.S. Application Data

(60) Continuation-in-part of application No. 15/807,851, filed on Nov. 9, 2017, now Pat. No. 10,052,535, which is a continuation-in-part of application No. 15/718,285, filed on Sep. 28, 2017, now Pat. No. 10,039,964, which is a division of application No. 15/665,004, filed on Jul. 31, 2017, now Pat. No. 9,808,685.

(60) Provisional application No. 62/457,086, filed on Feb. 9, 2017.

(51) Int. Cl.
*A63B 53/04* (2015.01)
*A63B 60/00* (2015.01)

(52) U.S. Cl.
CPC ..... *A63B 53/0475* (2013.01); *A63B 60/00* (2015.10); *A63B 2060/002* (2015.10); *A63B 2209/00* (2013.01)

(58) Field of Classification Search
USPC ..... 473/324–350
See application file for complete search history.

(56) References Cited

U.S. PATENT DOCUMENTS 4,650,626 A * 3/1987 Kurokawa ..... B29C 45/14 264/261
4,824,110 A * 4/1989 Kobayashi ..... A63B 53/04 473/332
5,007,643 A * 4/1991 Okumoto ..... A63B 53/04 473/346

(Continued)

*Primary Examiner* — Alvin Hunter
(74) *Attorney, Agent, or Firm* — Rebecca Hanovice; Michael Catania; Sonia Lari

(57) ABSTRACT

A golf club head with at least one cavity including a weight that is co-molded with a fill material comprising a polymer and a plurality of microscopic bubbles, and methods of manufacturing such golf club heads, are disclosed herein. The plurality of microscopic bubbles constitutes at 5-70% of the volume of the fill material, and more preferably approximately 20-30% of the volume of the fill material. The polymer material preferably is a polyurethane having a Poisson's ratio of 0.40-0.50. The weight is preferably composed of a metal alloy with a density greater than 4 g/cc, such as steel or tungsten alloy.

20 Claims, 11 Drawing Sheets

(56) References Cited

U.S. PATENT DOCUMENTS

| | | | | | |
|---|---|---|---|---|---|
| 5,465,969 | A * | 11/1995 | Cadorniga | A63B 53/04 | 473/346 |
| 5,507,985 | A * | 4/1996 | Cadorniga | A63B 53/04 | 264/45.3 |
| 6,533,679 | B1 * | 3/2003 | McCabe | A63B 53/0475 | 473/335 |
| 8,206,239 | B2 * | 6/2012 | Gilbert | A63B 53/047 | 473/324 |
| 9,808,685 | B1 * | 11/2017 | Westrum | A63B 53/047 | |
| 10,052,535 | B1 * | 8/2018 | Westrum | A63B 60/00 | |
| 2008/0058117 | A1 * | 3/2008 | Roach | A63B 53/047 | 473/332 |

* cited by examiner

GOLF CLUB HEAD COMPRISING MICROSCOPIC BUBBLE MATERIAL

CROSS REFERENCES TO RELATED APPLICATIONS

The present application is a continuation-in-part of U.S. patent application Ser. No. 15/807,851, filed on Nov. 8, 2017, which is a continuation-in-part of U.S. patent application Ser. No. 15/718,285, filed on Sep. 28, 2017, which is a division of U.S. patent application Ser. No. 15/665,004, filed on Jul. 31, 2017, and issued on Nov. 7, 2017, as U.S. Pat. No. 9,808,685, which claims priority to U.S. Provisional Patent Application No. 62/457,086, filed on Feb. 9, 2017, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to an iron-type golf club head comprising a novel polymeric fill material that improves the sound of the club head without significantly reducing the golf club head's ball speed or coefficient of restitution. The fill material is preferably co-molded with a metal slug that is disposed within the golf club head to lower the center of gravity of the golf club head.

Description of the Related Art

Golf club heads, and particularly iron-type golf club heads, often include polymeric materials disposed behind the striking face to improve or dampen the sound of the head upon impact with a golf ball. For example, U.S. Pat. No. 5,492,327 discloses an iron with a damping material in a recess, U.S. Pat. No. 6,743,117 discloses a dampening insert behind a strike face insert in an iron, and U.S. Pat. No. 9,168,437 discloses an elastomeric insert attached to the back of the striking face of an iron. Unfortunately, while a polymer fill or insert can improve the sound of the golf club in which it is disposed, this configuration reduces ballspeed off the face, as well as the coefficient of restitution (COR) of the golf club head. This occurs because polymers such as urethane are rigid, with a Poisson's ratio of around 0.5, and when a polymer fills a cavity or space, the polymer prevents the golf club face from flexing. Therefore, there is a need for a golf club head comprising an improved fill material that also preserves, or otherwise optimizes, ballspeed and COR values.

BRIEF SUMMARY OF THE INVENTION

The golf club head comprises a novel fill material comprising microscopic bubbles (also referred to as hollow beads) made from a strong, lightweight, low-density material such as glass, ceramic, and/or plastic, mixed with a polymeric material, preferably urethane or silicone, at least partially filling a cavity within the club head or affixed to a portion of the club head in medallion form. The presence of the microscopic bubbles in the polymeric material prevents the COR of the golf club head from decreasing by more than 0.10, and more preferably by more than 0.05, when compared with a golf club head having all of the same features and characteristics but which lacks a polymeric fill material completely.

One aspect of the present invention is a golf club head, such as an iron, putter, driver, fairway wood, or wedge, comprising a body comprising a striking face, sole portion, top portion, rear portion, and cavity, and a fill material at least partially filling the cavity, wherein the fill material comprises a first material and a plurality of microscopic bubbles composed of a second material, wherein the first material is a polymer and wherein the second material is different from the first material, and wherein the plurality of microscopic bubbles constitutes 5% to 70% of a volume of the fill material. In some embodiments, the polymer material may be selected from the group consisting of polyurethane and silicone. In other embodiments, wherein the second material may be selected from the group consisting of glass, ceramic, and plastic. In still other embodiments, the plurality of microscopic bubbles may constitute at least 20% of the volume of the fill material, and in a further embodiment, 25-30% of the volume of the fill material. In still other embodiments, the polymer material may have a Poisson's ratio of 0.00-0.50, and more preferably 0.40-0.50. In still other embodiments, when a central area of the striking face impacts a golf ball, the golf club head may have a pitch of 3000-6000 Hz, an amplitude of 90-100 dB, a duration of 1-2.5 ms, and a ball speed of at least 112.5 mph. In still other embodiments, the fill material may be a medallion affixed to a rear surface of the striking face.

Another aspect of the present invention is a method comprising the steps of providing a golf club head comprising a body having at least one cavity, providing a polymer material, providing a plurality of microscopic bubbles composed of a low-density material, combining the plurality of microscopic bubbles with the polymer material to create a fill material, and injecting the fill material into the at least one cavity of the golf club head, wherein the plurality of microscopic bubbles constitutes 5-70% of a volume of the fill material. In some embodiments, the plurality of microscopic bubbles may constitute approximately 25-30% of the volume of the fill material. In other embodiments, the polymer material may be selected from the group consisting of polyurethane and silicone, the low-density material may be composed of a material selected from the group consisting of glass, ceramic, and plastic.

Yet another aspect of the present invention is a method comprising the steps of providing a golf club head comprising a body having at least one cavity, providing a polymer material, providing an agent material selected from the group consisting of a curative and a catalyst, providing a plurality of microscopic bubbles composed of a material selected from the group consisting of glass, ceramic, and plastic, combining the plurality of microscopic bubbles with the agent material to create an intermediary material, combining the intermediary material with the polymer material to create a fill material, and injecting the fill material into the at least one cavity of the golf club head, wherein the plurality of microscopic bubbles constitutes 5-70% of a volume of the intermediary material. In some embodiments, the plurality of microscopic bubbles may be combined with the agent material at a 5:3 ratio, and the fill material may comprise a 1:1 ratio of polymer material and intermediary material. In other embodiments, the plurality of microscopic bubbles may constitute approximately 20-30% of the volume of the intermediary material. In still other embodiments, the polymer material may have a Poisson's ratio of 0.40-0.50 and be selected from the group consisting of polyurethane and silicone. In one embodiment, the golf club head may be an iron-type golf club head comprising a body having a striking face, a sole portion, a top portion, and a rear portion, the at least one cavity may be disposed between the striking face and the rear portion, and the fill material may completely fill the at least one cavity. In a further embodiment, the method may comprise the step of curing the golf club head in an oven after the step of injecting the fill material into the at least one cavity of the golf club head.

Another aspect of the present invention is a method comprising the steps of providing a golf club head comprising a body having at least one cavity, providing a polymer material having a Poisson's ratio of 0.40-0.50, providing an agent material selected from the group consisting of a curative and a catalyst, providing a plurality of microscopic bubbles composed of a material selected from the group consisting of glass, ceramic, and plastic, combining the polymer material with the agent material to form an intermediary material, combining the plurality of microscopic bubbles with the intermediary material to create a fill material, injecting the fill material into the at least one cavity of the golf club head, and curing the fill material within the golf club head, wherein the plurality of microscopic bubbles constitutes 5-70% of a volume of the fill material. In some embodiments, the golf club head may be an iron-type golf club head, the plurality of microscopic bubbles may constitute approximately 20-30% of the volume of the fill material, and the polymer material may be selected from the group consisting of polyurethane and silicone.

Yet another aspect of the present invention is a golf club head comprising a body comprising a striking face, sole portion, top portion, rear portion, and cavity, a metal weight, and a fill material comprising a first material and a plurality of microscopic bubbles composed of a second material, wherein the second material is different from the first material, wherein the metal weight is disposed within the cavity, wherein the fill material at least partially envelops the metal weight and at least partially fills the cavity, and wherein the plurality of microscopic bubbles constitutes 5% to 70% of a volume of the fill material. In some embodiments, the first material may be selected from the group consisting of polyurethane and silicone. In other embodiments, the second material may be selected from the group consisting of glass, ceramic, and plastic, and each of the plurality of microscopic bubbles may have a diameter of approximately 18-50 microns. In still other embodiments, the plurality of microscopic bubbles may constitute at least 20% of the volume of the fill material, such as 25-30% of the volume of the fill material. In other embodiments, the polymer material may have a Poisson's ratio of 0.00-0.50, and more specifically, 0.40-0.50. In still other embodiments, the metal weight may be composed of tungsten alloy, and the fill material may completely envelop the metal weight. In another embodiment, a combination of the metal weight and the fill material may completely fill the cavity. In any of these embodiments, the golf club head may be an iron-type golf club head.

Another aspect of the present invention is a method method comprising the steps of providing a golf club head comprising a body having a cavity, providing a metal weight, providing a fill material comprising a polymer material and a plurality of microscopic bubbles composed of a low-density material, injection-molding the fill material onto the metal weight to create a co-molded weight, and inserting the co-molded weight into the cavity. In some embodiments, the plurality of microscopic bubbles may constitute approximately 25-30% of the volume of the fill material. In another embodiment, the polymer material may be selected from the group consisting of polyurethane and silicone, and the low-density material may be composed of a material selected from the group consisting of glass, ceramic, and plastic. In a further embodiment, the golf club head may be an iron-type golf club head comprising a body having a striking face, a sole portion, a top portion, and a rear portion, the at least one cavity may be disposed between the striking face and the rear portion, and a combination of the metal weight and the fill material may completely fill the at least one cavity.

Yet another aspect of the present invention is a method comprising the steps of providing a golf club head comprising a body having a cavity, providing a metal weight, providing a fill material comprising a polymer material and a plurality of microscopic bubbles composed of a low-density material, inserting the metal weight into the cavity, and injection-molding the fill material into the cavity and around at least a portion of the metal weight. In some embodiments, the polymer material may be selected from the group consisting of polyurethane and silicone, and the low-density material may be selected from the group consisting of glass, ceramic, and plastic. In a further embodiment, the plurality of microscopic bubbles may constitute 25-30% of the volume of the fill material, and each of the plurality of microscopic bubbles may have a diameter of approximately 18-50 microns. In any of the embodiments, the metal weight may be composed of a metal alloy having a density of greater than 4 g/cc.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

The present invention is directed to golf club heads, and particularly iron-type golf club heads, which include a novel fill material comprising a polymeric material and a plurality of microscopic bubbles made of glass, ceramic, and/or plastic, also referred to herein as microscopic, hollow beads. The microscopic bubbles serve two purposes when incorporated with a polymeric material: (1) they lighten the overall fill weight by replacing elastomer with air, thus lowering the material's specific gravity; and (2) they increase the porosity of the fill material, allowing for the formation of micro-holes in the polymeric material. The micro-holes are little air pockets that allow the polymer to flex when the club head impacts a golf ball, thus increasing the COR of the head while at the same time maintaining the sound improvement provided by the polymer itself, such as reduction in dB level and duration. The polymeric material preferably is an elastomer such as polyurethane or silicone having a Poisson's ratio of 0.00-0.50, and more preferably 0.40-0.50, and the microscopic bubbles preferably are measured in D50 micron, which is the median particle size for a measured sample, each microscopic bubble having a diameter of approximately 18-50 microns.

Figure 1:
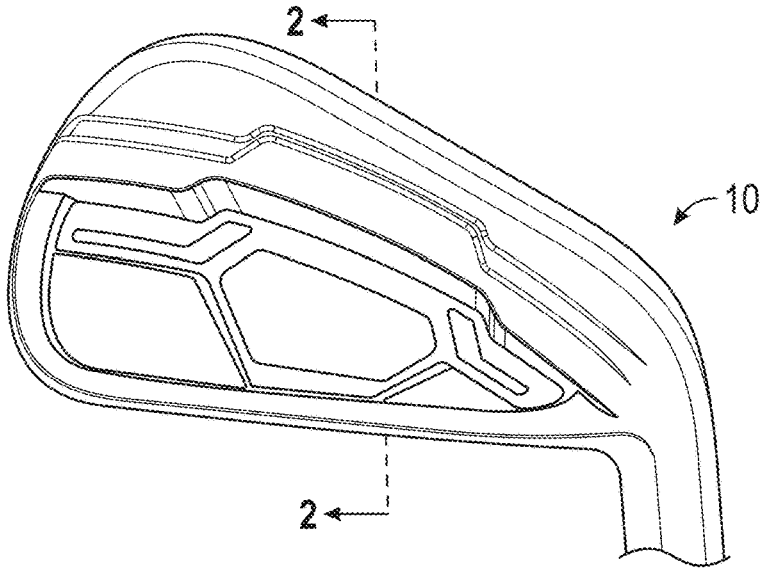
FIG. 1 is a rear elevational view of an iron-type golf club head of the present invention.
Figure 2:
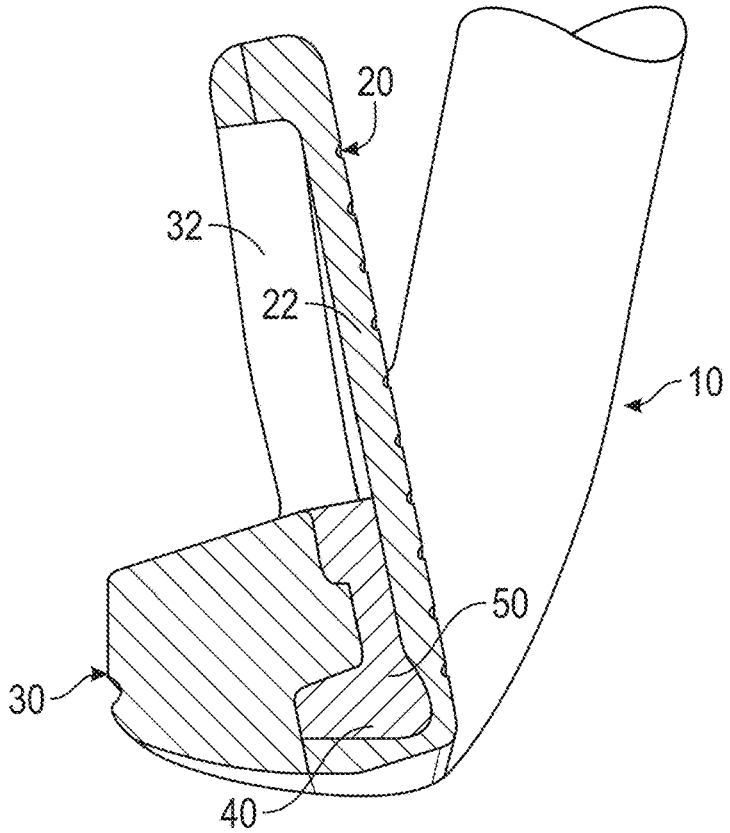
FIG. 2 is a cross-sectional view of the embodiment shown in FIG. 1 along lines 2-2.

A preferred embodiment of the golf club head is shown in FIGS. 1 and 2. In this embodiment, the golf club head 10 is a cavity back iron having a face cup 20, a body 30, and a cavity 40 between the body and the striking portion 22 of the face cup. The cavity 40 is completely filled with the microscopic bubble fill material 50, which does not extend into the upper cavity portion 32 of the body 30.

Figure 3:
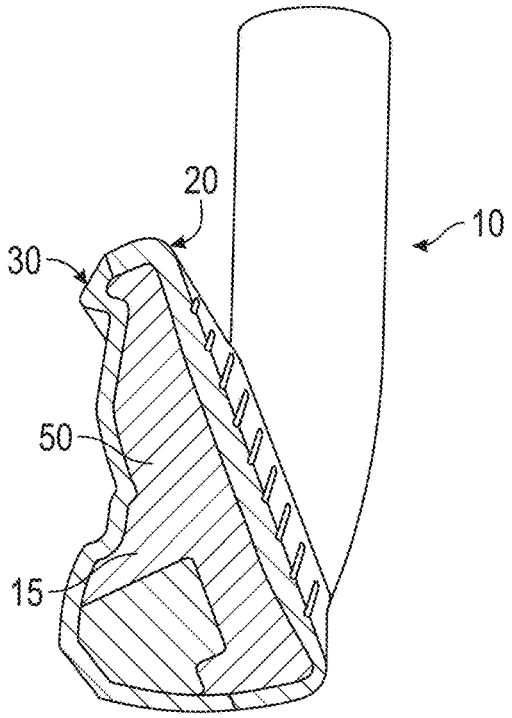
FIG. 3 is a cross-sectional view of a second embodiment of the present invention.

In an alternative embodiment, shown in FIG. 3, the golf club head 10 is a closed cavity back iron with a hollow interior 15, which is completely filled with the microscopic bubble fill material 50.

Figure 4:
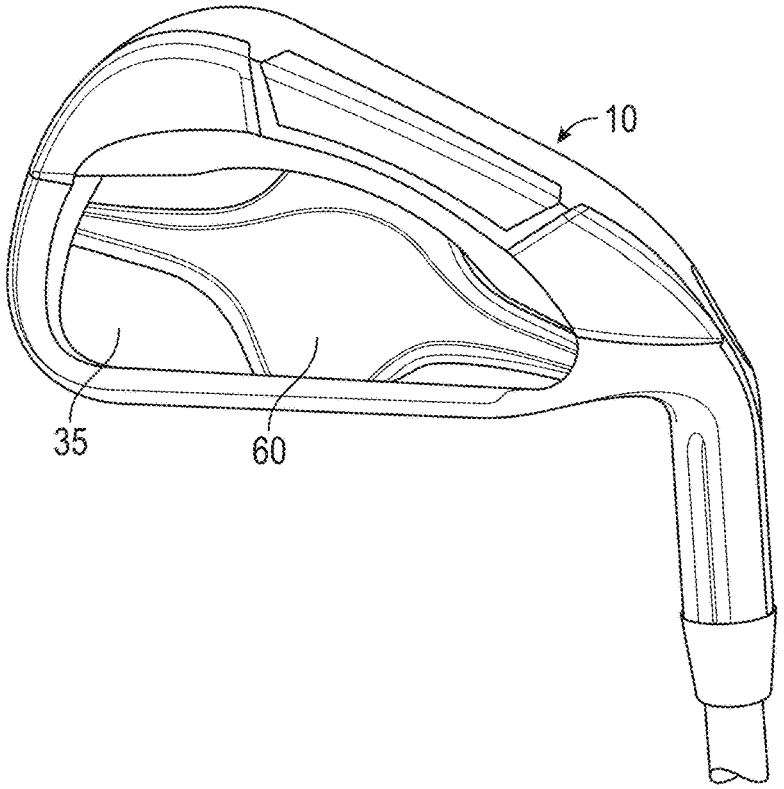
FIG. 4 is a rear elevational view of a third embodiment of the present invention.

In yet another embodiment, shown in FIG. 4, the golf club head 10 has an open cavity back 35 with a medallion 60 molded or otherwise formed from the microscopic bubble fill material 50 affixed to a rear surface 23 of the striking portion 22. When the microscopic bubble fill material 50 is incorporated into a medallion 60, it is preferably placed onto a back side of an electroformed medallion and permitted to cure, and then an adhesive is placed on the fill material 50 and used to bond the medallion 60 onto the club head 10.

In each of the embodiments disclosed herein, the microscopic bubbles in the novel fill material 50 preferably constitute 5% to 70% by volume of the fill material 50, more preferably at least 20% of the volume, and most preferably approximately 25-30% of the fill material's 50 volume.

Figure 5:
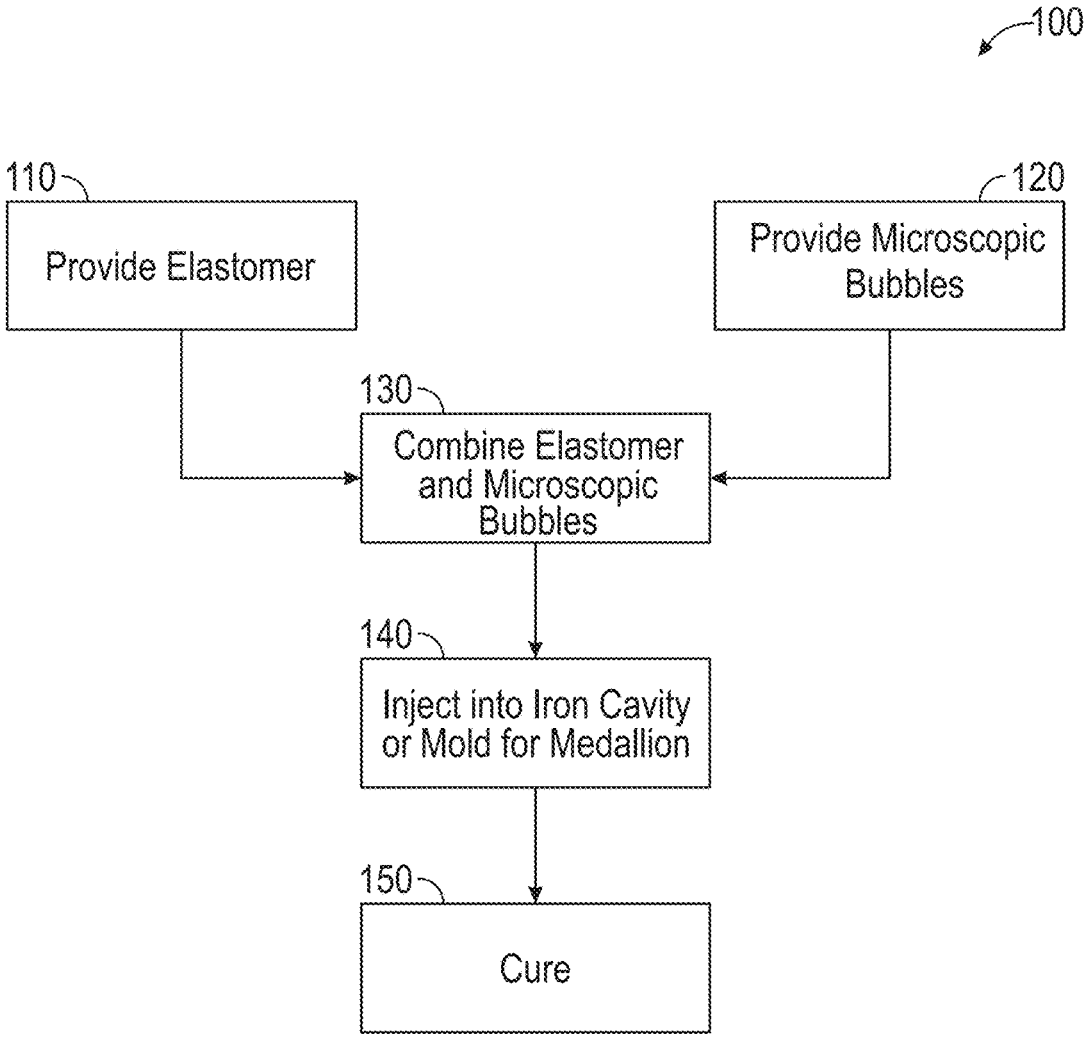
FIG. 5 is a flow chart illustrating a first method of preparing the polymer fill material shown in FIGS. 2-4.

There are several methods of manufacturing the microscopic bubble fill material 50 and incorporating it into the golf club head 10 according to the present invention. The first method 100, shown in FIG. 5, comprises the steps of providing an elastomer material 110 such as polyurethane, providing microscopic bubbles 120, combining the microscopic bubbles with the elastomer material 130 so that the microscopic bubbles form 5-70% of the volume of the resulting mixture, and more preferably approximately 25-30% of the volume of the resulting material, injecting the resulting mixture into a cavity 40 or hollow interior 15 of the golf club head, or a mold for a medallion 140, and then oven curing the mixture or otherwise allowing it to cure 150 (e.g., at air temperature for self-curing materials).

Figure 6:
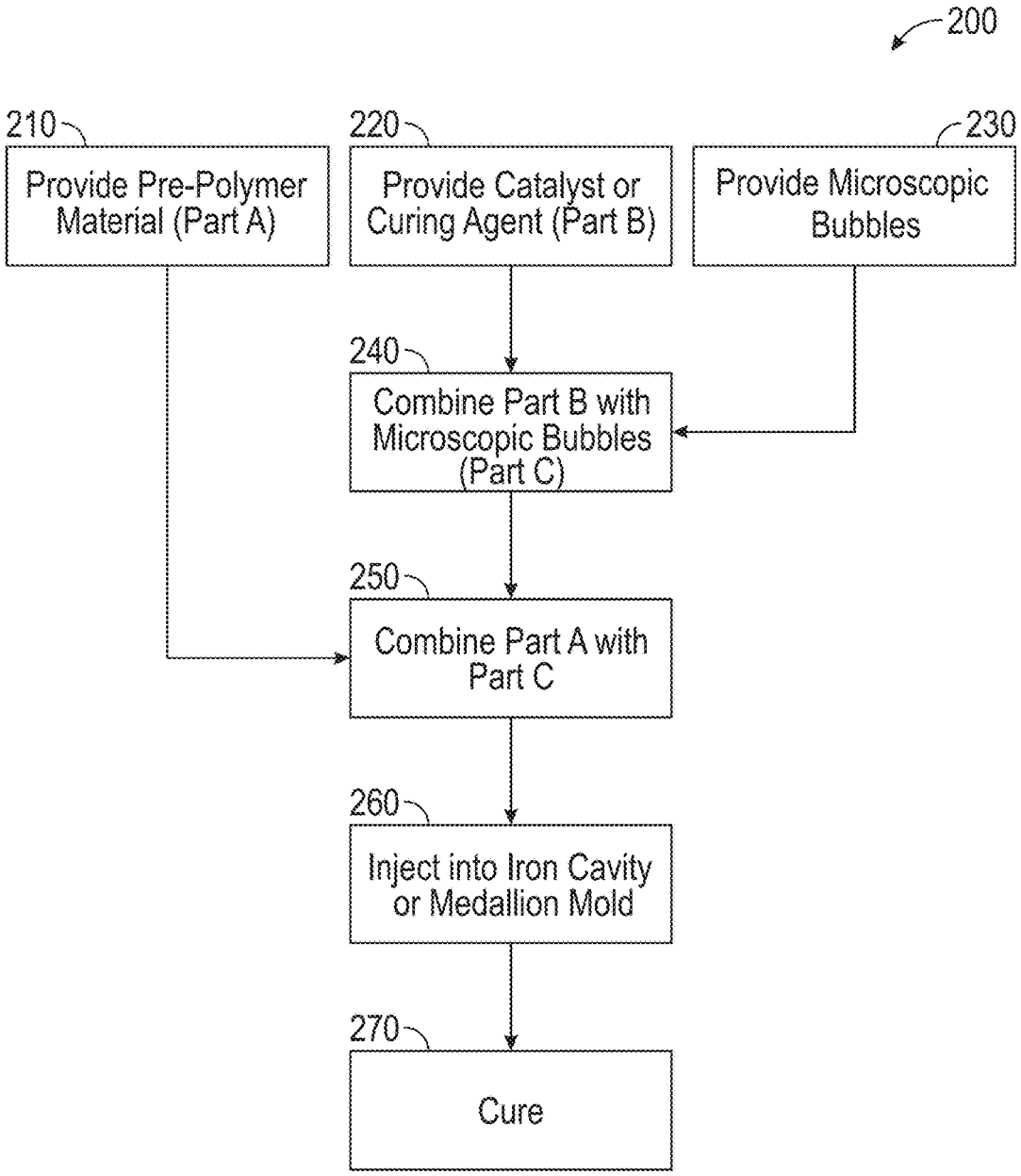
FIG. 6 is a flow chart illustrating a second method of preparing the polymer fill material shown in FIGS. 2-4.

The second, preferred method 200, shown in FIG. 6, comprises the steps of providing a pre-polymer resin (Part A) 210 such as a polyurethane or silicone, providing a curing or catalyst agent (Part B) 220, and providing the microscopic bubbles 230, combining the curing or catalyst agent (Part B) with the microscopic bubbles to form an intermediary material (Part C) 240 that is 5-70% by volume of microscopic bubbles, and more preferably 25-30% by volume, combining the intermediary material (Part C) with the polymer resin (Part A) 250, preferably in a 1:1 Part A to Part B ratio, to form a final mixture, injecting the final mixture into a cavity 40 or hollow interior 15 of the golf club head, or a mold for a medallion 260, and then oven curing the mixture or otherwise allowing it to cure 270. The benefit of this method 200 is that the intermediary material (Part C) can be prepared and placed into storage until a manufacturer is ready to catalyze the pre-polymer resin.

Figure 7:
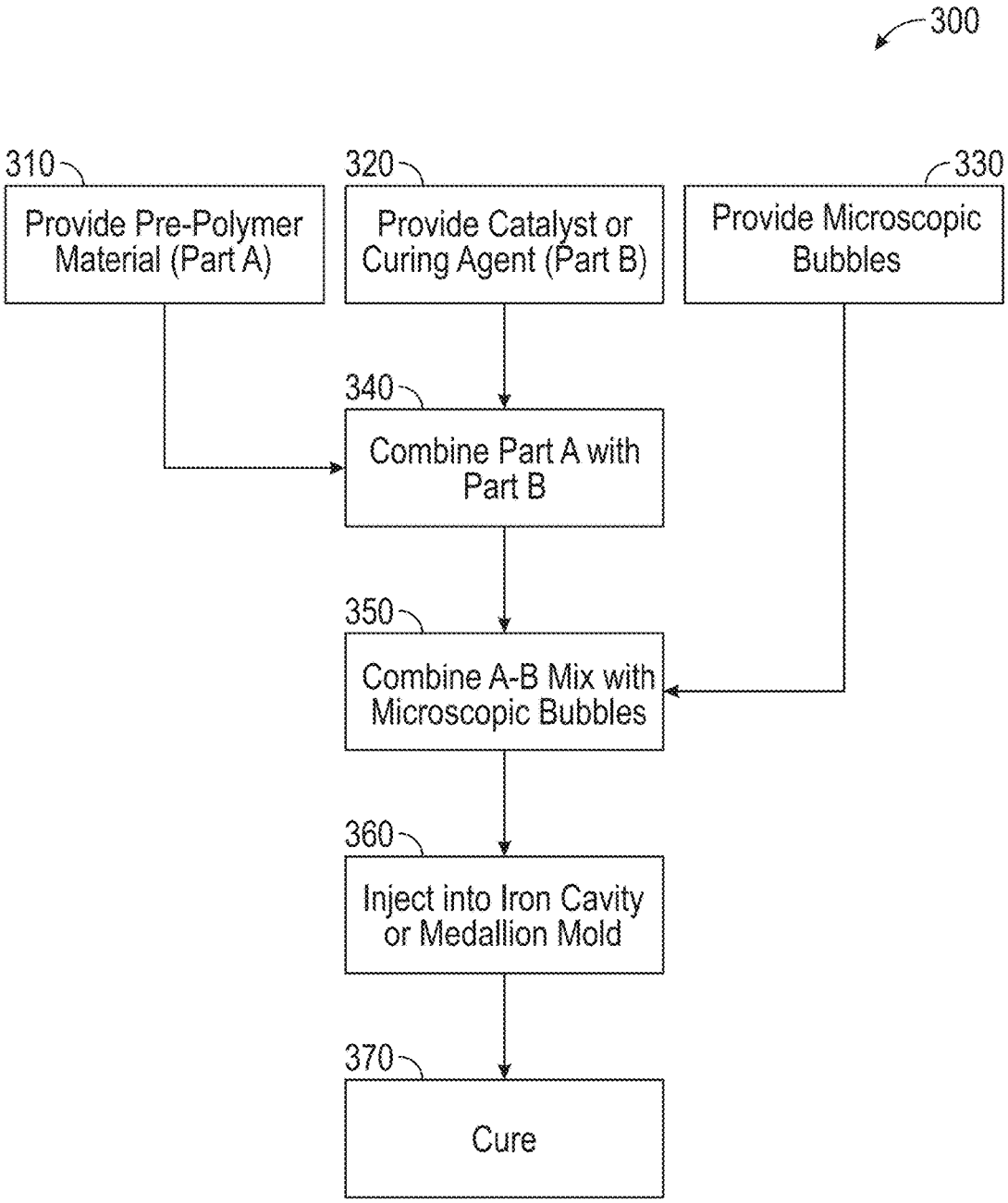
FIG. 7 is a flow chart illustrating a third method of preparing the polymer fill material shown in FIGS. 2-4.

The third method of the present invention is shown in FIG. 7. This method 300 comprises the steps of providing a pre-polymer resin (Part A) 310 (preferably polyurethane or silicone), providing a curing or catalyst agent (Part B) 320, and providing the microscopic bubbles 330, combining the polymer resin (Part A) with the curing or catalyst agent (Part B) 340, preferably in a 1:1 Part A to Part B ratio, to form an intermediary material, combining the intermediary material with microscopic bubbles 350 so that the microscopic bubbles are 5-70% of the volume of the resulting material, and more preferably 25-30% of the volume, injecting the resulting material into a cavity 40 or hollow interior 15 of the golf club head, or a mold for a medallion 360, and then oven curing the mixture or otherwise allowing it to cure 370.

In order to assess the COR performance of the inventive material, test iron-type golf club heads 10 having unfilled (empty) cavities were created and tested, and compared against golf club heads 10 having the same construction and filled with (1) the novel microscopic bubble fill material 50 comprising polyurethane and glass bubbles and made using one of the second 200 and third methods 300 and (2) polyurethane only. As shown in Tables 1 and 2, the polyurethane-only fill significantly lowers the COR of the golf club head 10. In contrast, when a golf club head cavity is filled with the microscopic bubble fill material 50 (glass) of the present invention, the COR decreases, on average, only by 0.04, thereby retaining the performance benefits of an unfilled golf club head 10. This is particularly evident when the microscopic bubbles or hollow microscopic beads constitute approximately 25% or 30% of the volume of the fill material 50, as shown in Table 1.

TABLE 1

| Test Club No. | COR (no fill) | | Change in COR |
|---|---|---|---|
| | | COR (polyurethane only) | |
| 1. | 0.827 | 0.806 | −0.021 |
| 2. | 0.827 | 0.806 | −0.021 |
| 3. | 0.824 | 0.812 | −0.012 |
| 4. | 0.818 | 0.796 | −0.022 |
| 5. | 0.813 | 0.793 | −0.020 |
| | | Average change in COR | −0.019 |
| | | COR (30% glass bubble fill) | |
| 6. | 0.825 | 0.820 | −0.005 |
| 7. | 0.823 | 0.818 | −0.005 |
| 8. | 0.826 | 0.821 | −0.005 |

TABLE 1-continued

| Test Club No. | COR (no fill) | | Change in COR |
|---|---|---|---|
| 9. | 0.825 | 0.821 | −0.004 |
| 10. | 0.826 | 0.823 | −0.003 |
| 11. | 0.825 | 0.823 | −0.002 |
| 12. | 0.823 | 0.817 | −0.006 |
| 13. | 0.821 | 0.817 | −0.004 |
| 14. | 0.818 | 0.816 | −0.002 |
| 15. | 0.816 | 0.813 | −0.003 |
| 16. | 0.825 | 0.821 | −0.004 |
| 17. | 0.825 | 0.817 | −0.008 |
| | | COR (25% glass bubble fill) | |
| 18. | 0.824 | 0.821 | −0.003 |
| 21. | 0.823 | 0.817 | −0.006 |
| | | Average change in COR | −0.004 |

TABLE 2

| Test Club No. | COR (no fill) | | Change in COR |
|---|---|---|---|
| | | COR (polyurethane only) | |
| 1. | 0.813 | 0.793 | −0.20 |
| | | COR (5% glass bubble fill) | |
| 2. | 0.815 | 0.804 | −0.11 |

Figure 8:
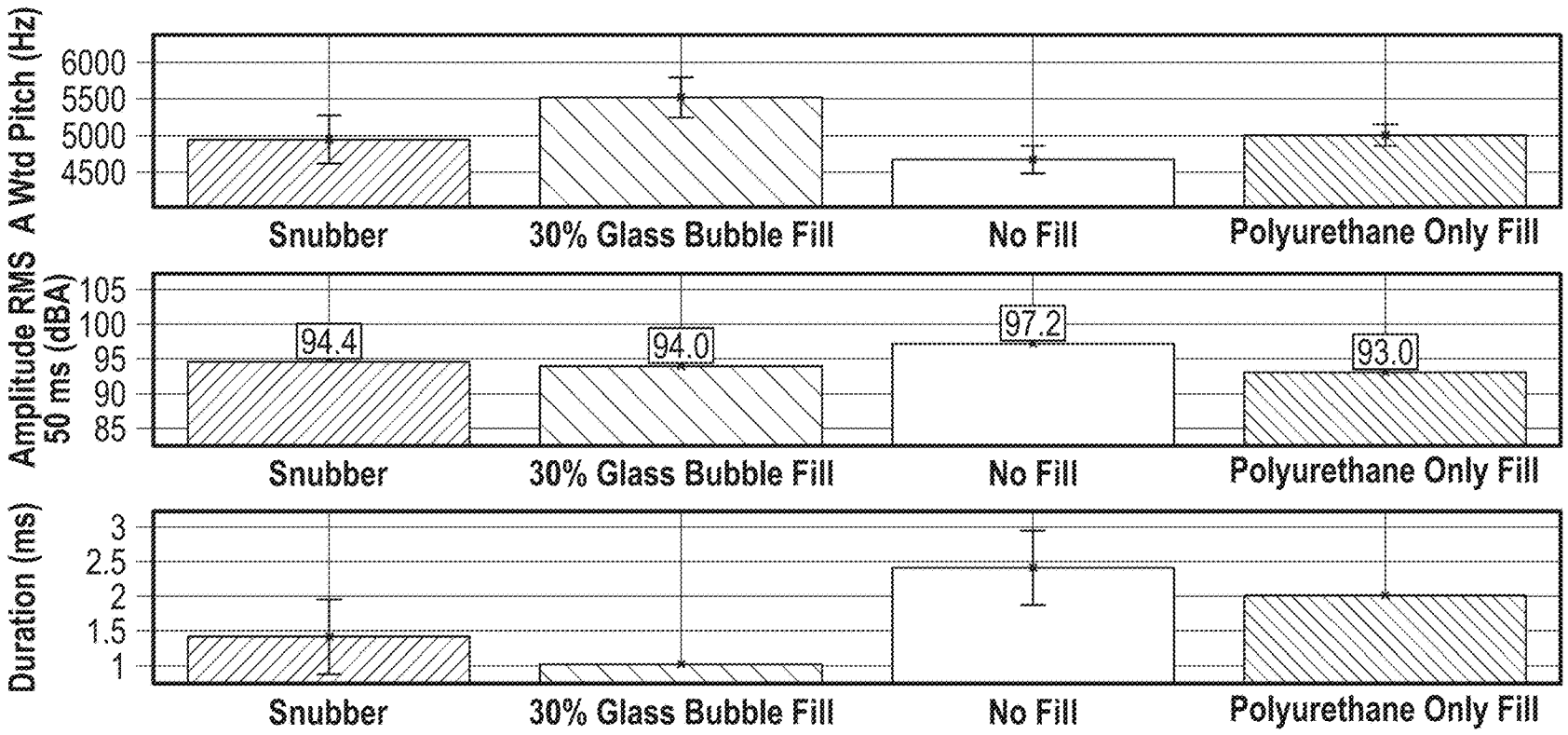
FIGS. 8-9 are charts showing sound measurements of the golf club head shown in FIG. 1 with and without different polymer fill materials and configurations.
Figure 9:
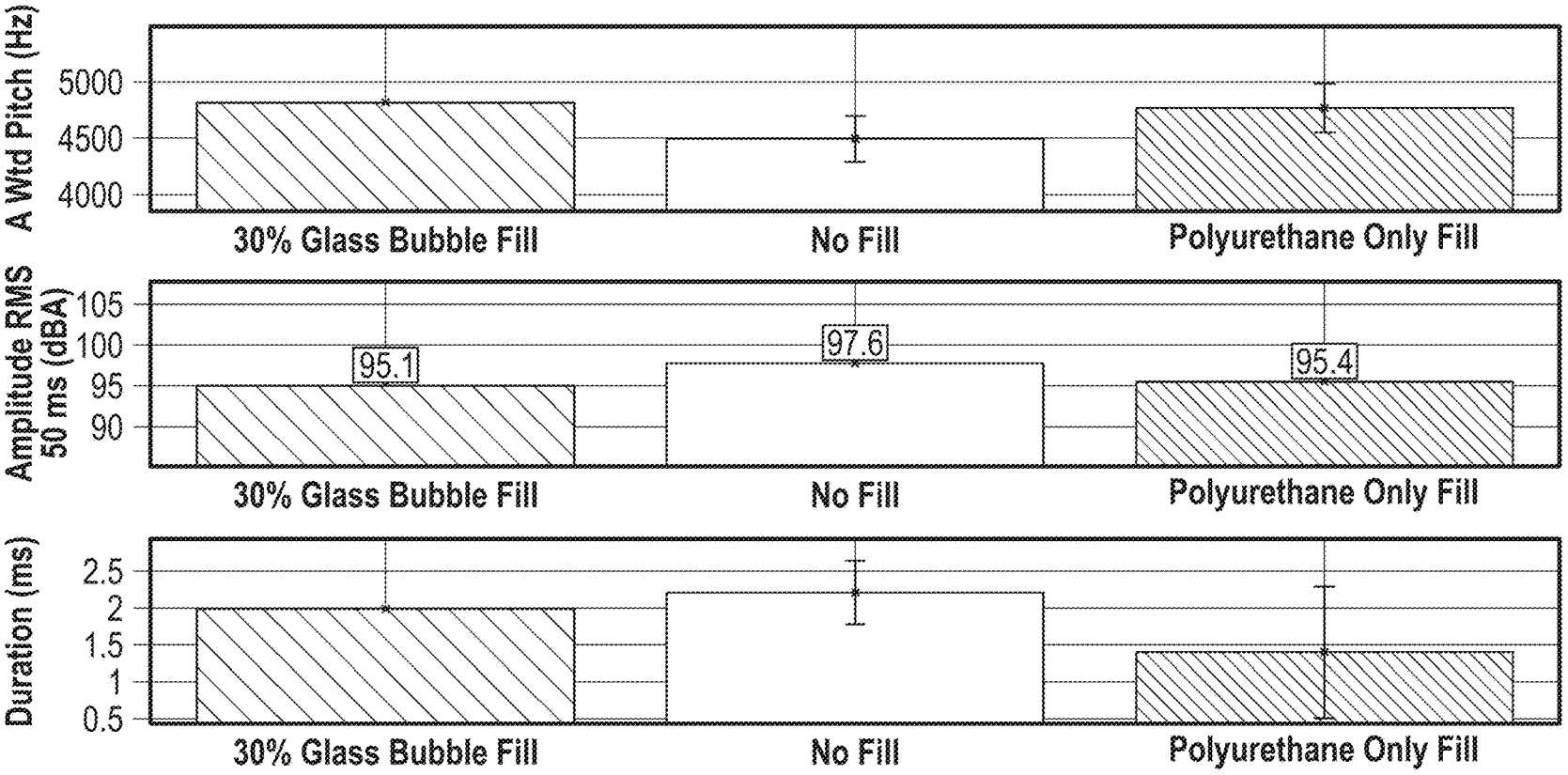

In order to assess sound performance, another group of test golf club heads 10 incorporating the 30% by volume novel microscopic bubble fill material 50 comprising polyurethane and glass bubbles, and made using one of the second 200 and third methods 300 were tested and compared with golf club heads 10 having: (1) the same construction and filled with only polyurethane; (2) no polyurethane filler at all; and (3) a small polyurethane snubber insert. As shown in FIGS. 8 and 9, the 30% by volume microscopic bubble fill material 50 improves the pitch and amplitude of the golf club head 10 upon impact with a golf ball compared to a polyurethane-only fill, thereby improving the overall sound of the golf club head 10. Preferably, a golf club head 10 incorporating the novel fill material has a pitch upon impact with a golf ball of 3000-6000 Hz, and more preferably of 4500-6000 Hz, an amplitude of 90-100 dB, and a duration of 1.0-2.5 ms.

Figure 10:
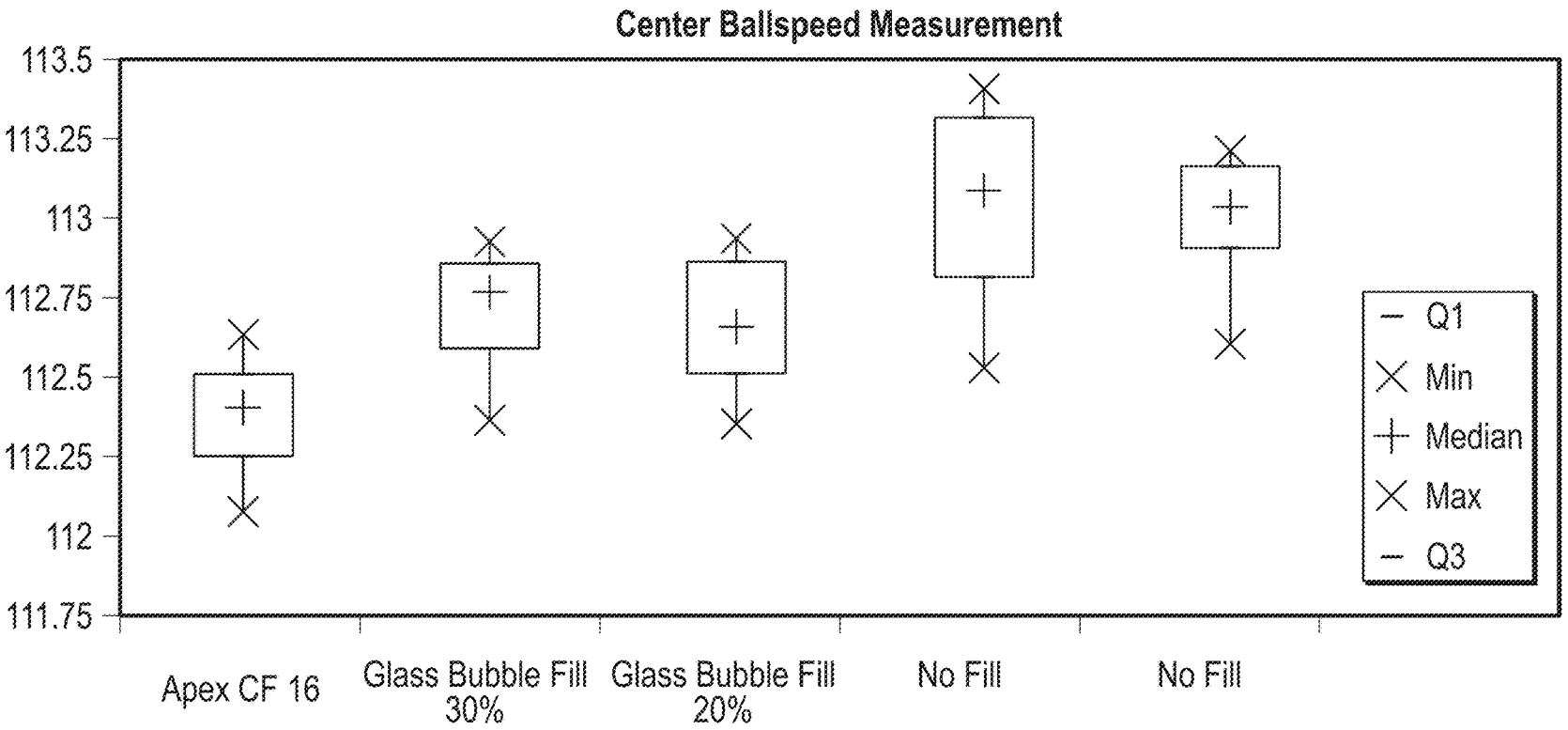
FIG. 10 is a box plot showing ball speed measurements taken from a central area of the face of test 6 iron heads having different polymer fill materials and configurations.
Figure 11:
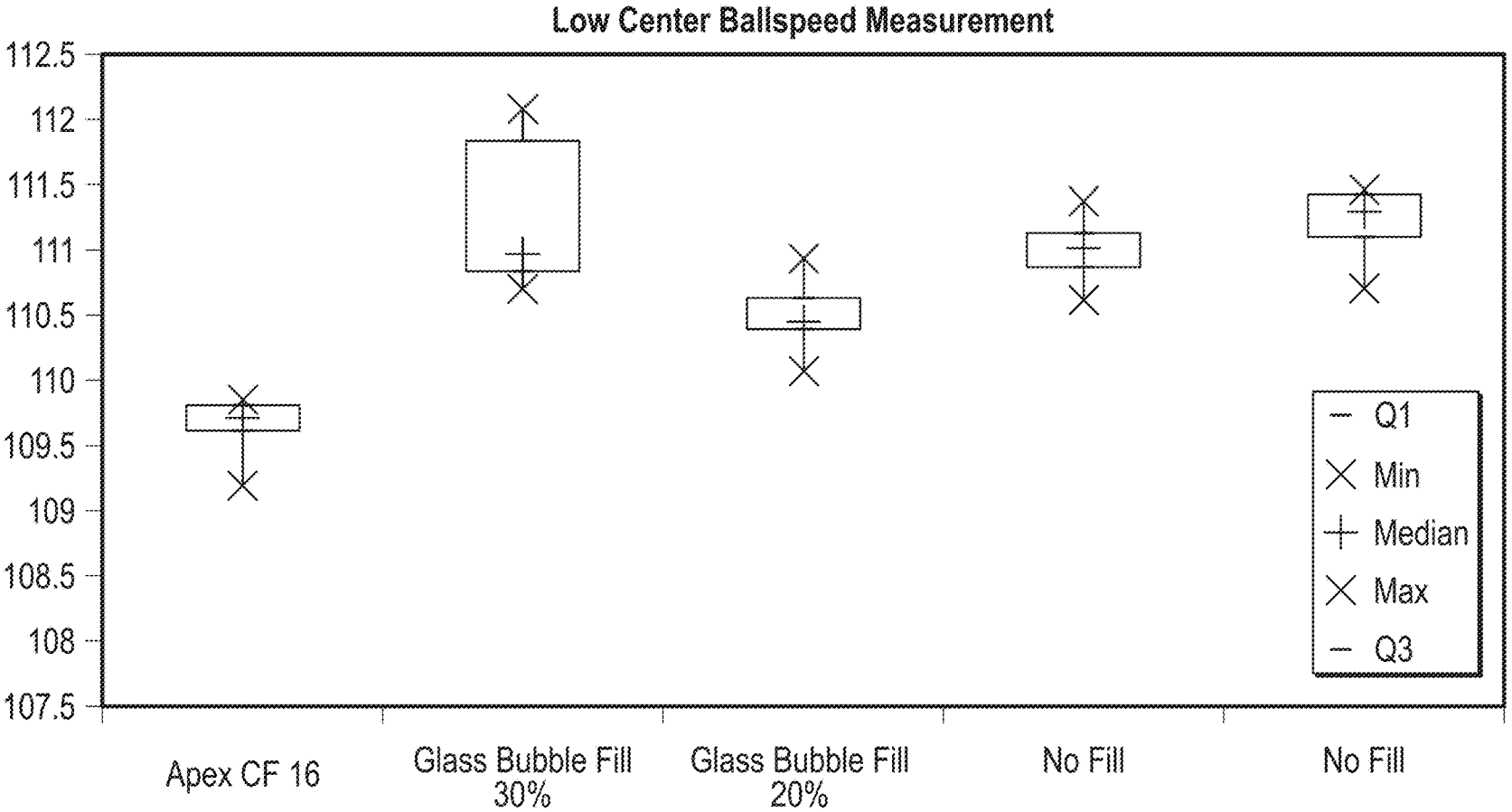
FIG. 11 is a box plot showing ball speed measurements taken from a low-central area of the face of test 6 iron heads having different polymer fill materials and configurations.

To assess the effects of the novel fill material on ball speed performance, the performance of a Callaway Golf Apex CF 16 6-iron comprising a small polymeric snubber was compared with the performance of test 6-irons having no fill, test 6-irons with a fill having 30% by volume microscopic bubbles (glass material), and test 6-irons with a fill having 20% by volume microscopic bubbles (glass material). As shown in FIGS. 10 and 11, the test irons comprising the novel, microscopic bubble fill had a higher median ball speed measured at both the center and low center of the striking face compared with the Apex CF 16 6-iron, and approached or surpassed the ball speed of test clubs lacking a fill material.

Figure 12:
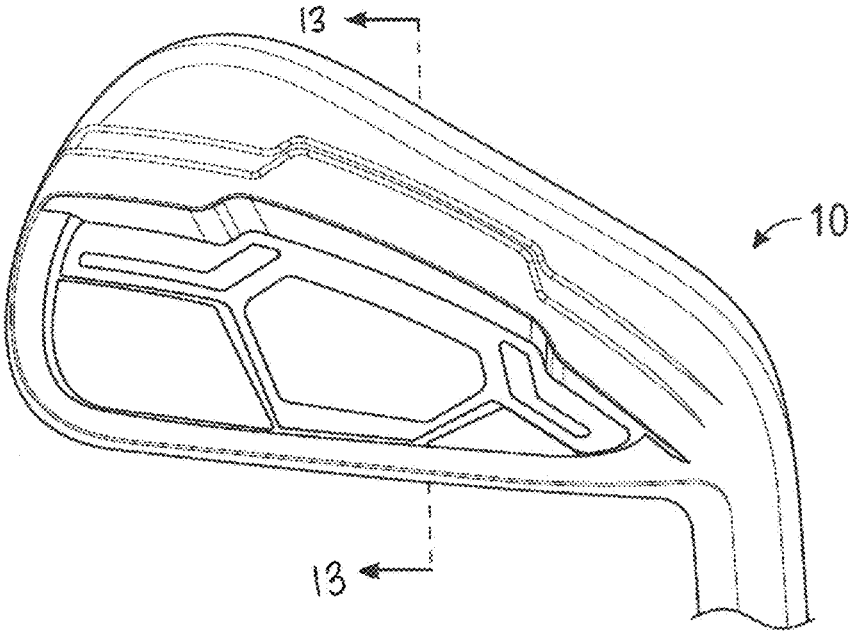
FIG. 12 is a rear elevational view of a fourth embodiment of the present invention.
Figure 13:
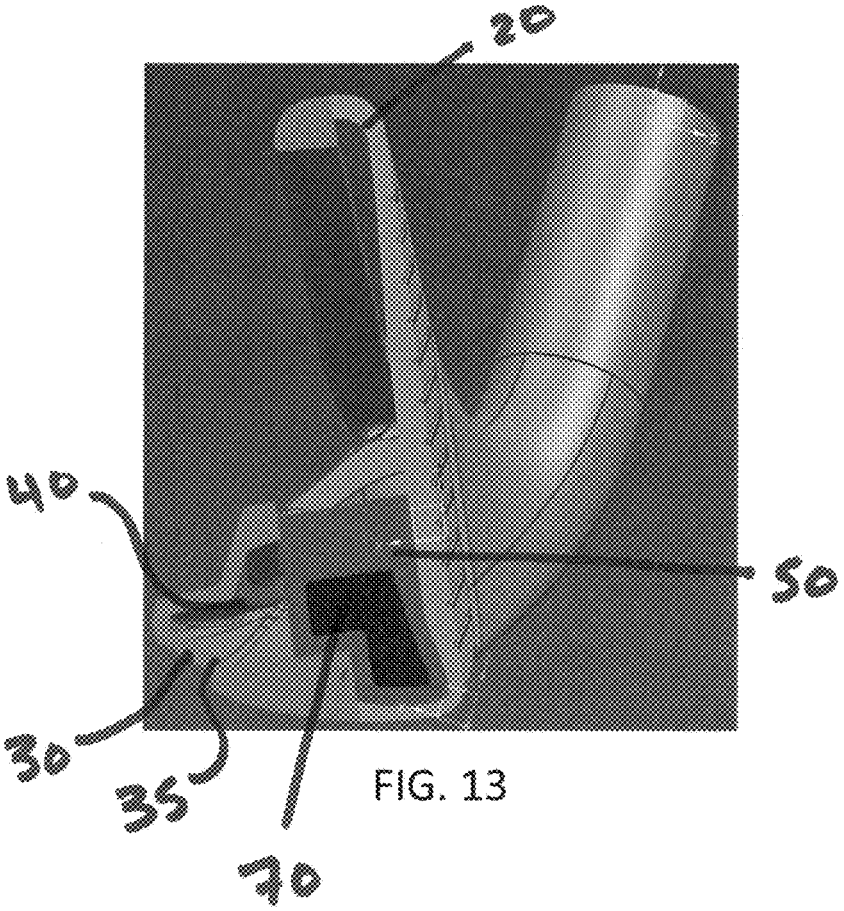
FIG. 13 is a cross-sectional view of the embodiment shown in FIG. 12 along lines 13-13.

In yet another embodiment of the present invention, shown in FIGS. 12 and 13, the golf club head 10 has many of the same features as the embodiments shown in FIGS. 1-3, except that the cavity 40 extends further into a rear portion 35 of the body 30 of the golf club head 10, and the golf club head 10 includes a weight 70 sized to fit within at least a portion of the cavity 40. The weight 70, which preferably is composed of a metal alloy material having a density of 4 g/cc or greater, such as steel or tungsten alloy, is over-molded with the novel fill material 50 of the present invention, which preferably completely envelops the weight 70 and at least partially fills the cavity 40 of the golf club head 10. This embodiment serves to move mass downwards and towards the striking portion 22 of the face cup 20 without compromising the COR of the golf club head 10.

Figure 14:
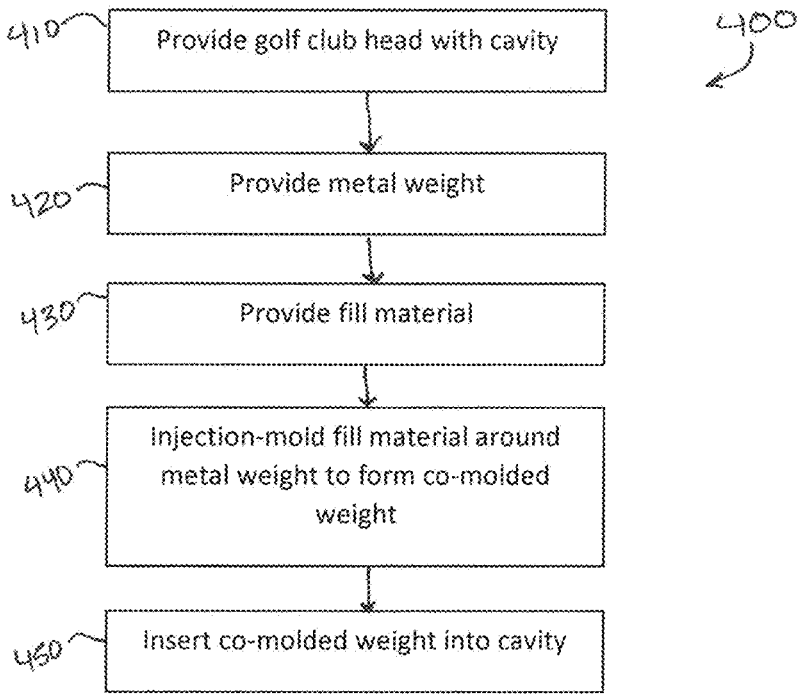
FIG. 14 is a flow chart illustrating a first method of preparing the golf club head shown in FIGS. 12-13.
Figure 15:
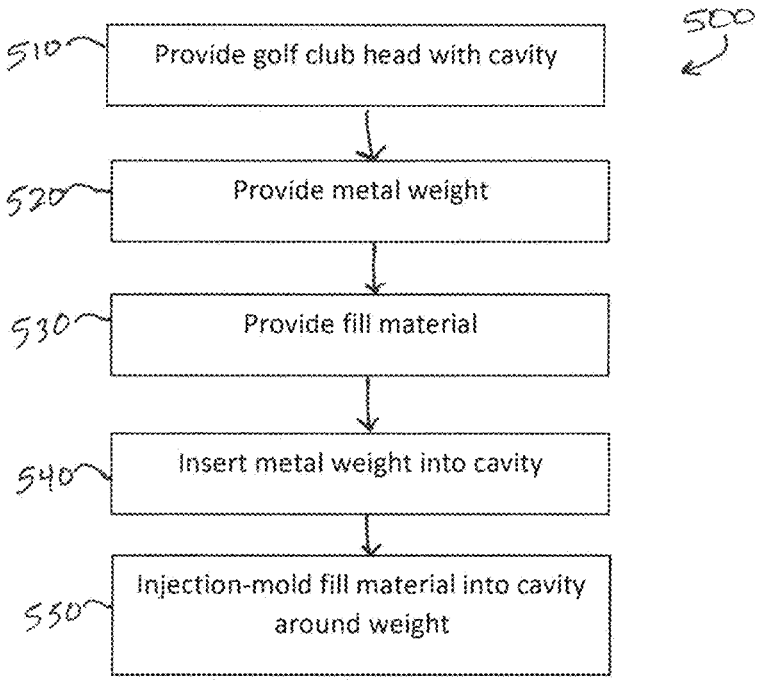
FIG. 15 is a flow chart illustrating a second method of preparing the golf club head shown in FIGS. 12-13.

The embodiment shown in FIGS. 12-13 can be achieved via several methods. A first method 400, shown in FIG. 14, comprises the steps of providing a golf club head comprising a body having a cavity 410, providing a metal weight 420, providing a fill material 50 comprising a polymer material and a plurality of microscopic bubbles composed of a low-density material 430, injection-molding the fill material onto the metal weight to create a co-molded weight 440, and inserting the co-molded weight into the cavity 450. An alternative method 500, shown in FIG. 15, comprises the steps of providing a golf club head comprising a body having a cavity 510, providing a metal weight 520, providing a fill material 50 comprising a polymer material and a plurality of microscopic bubbles composed of a low-density material 530, inserting the metal weight into the cavity 540, and injection-molding the fill material into the cavity and around at least a portion of the metal weight 550. Each of these methods produces a golf club head having a low center of gravity and an optimized COR.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a striking face, sole portion, top portion, rear portion, and cavity;

a metal weight; and a fill material comprising a first material and a plurality of microscopic bubbles composed of a second material, wherein the second material is different from the first material, wherein the metal weight is disposed within the cavity, wherein the fill material at least partially envelops the metal weight and at least partially fills the cavity, and wherein the plurality of microscopic bubbles constitutes 5% to 70% of a volume of the fill material.

2. The golf club head of claim 1, wherein the first material is selected from the group consisting of polyurethane and silicone.

3. The golf club head of claim 1, wherein the second material is selected from the group consisting of glass, ceramic, and plastic.

4. The golf club head of claim 3, wherein each of the plurality of microscopic bubbles has a diameter of approximately 18-50 microns.

5. The golf club head of claim 1, wherein the plurality of microscopic bubbles constitutes at least 20% of the volume of the fill material.

6. The golf club head of claim 5, wherein the plurality of microscopic bubbles constitutes 25-30% of the volume of the fill material.

7. The golf club head of claim 1, wherein the polymer material has a Poisson's ratio of 0.00-0.50.

8. The golf club head of claim 7, wherein the polymer material has a Poisson's ratio of 0.40-0.50.

9. The golf club head of claim 1, wherein the metal weight is composed of tungsten alloy.

10. The golf club head of claim 1, wherein the fill material completely envelops the metal weight.

11. The golf club head of claim 1, wherein a combination of the metal weight and the fill material completely fills the cavity.

12. The golf club head of claim 1, wherein the golf club head is an iron-type golf club head.

13. A method comprising the steps of:

providing a golf club head comprising a body having a cavity;

providing a metal weight;

providing a fill material comprising a polymer material and a plurality of microscopic bubbles composed of a low-density material;

injection-molding the fill material onto the metal weight to create a co-molded weight; and inserting the co-molded weight into the cavity.

14. The method of claim 13, wherein the plurality of microscopic bubbles constitutes approximately 25-30% of the volume of the fill material.

15. The method of claim 13, wherein the polymer material is selected from the group consisting of polyurethane and silicone, and wherein the low-density material is composed of a material selected from the group consisting of glass, ceramic, and plastic.

16. The method of claim 15, wherein the golf club head is an iron-type golf club head comprising a body having a striking face, a sole portion, a top portion, and a rear portion, wherein the at least one cavity is disposed between the striking face and the rear portion, and wherein a combination of the metal weight and the fill material completely fills the at least one cavity.

17. A method comprising the steps of:

providing a golf club head comprising a body having a cavity;

providing a metal weight;

providing a fill material comprising a polymer material and a plurality of microscopic bubbles composed of a low-density material;

inserting the metal weight into the cavity; and injection-molding the fill material into the cavity and around at least a portion of the metal weight.

18. The method of claim 17, wherein the polymer material is selected from the group consisting of polyurethane and silicone, and wherein the low-density material is composed of a material selected from the group consisting of glass, ceramic, and plastic.

19. The method of claim 18, wherein the plurality of microscopic bubbles constitutes 25-30% of the volume of the fill material, and wherein each of the plurality of microscopic bubbles has a diameter of approximately 18-50 microns.

20. The golf club head of claim 17, wherein the metal weight is composed of a metal alloy having a density of greater than 4 g/cc.

* * * * *